US008087131B1

(12) United States Patent
Cheng

(10) Patent No.: US 8,087,131 B1
(45) Date of Patent: Jan. 3, 2012

(54) STRETCHING ASSEMBLY FOR CLOTH

(76) Inventor: Yuan-Long Cheng, Xinying (TW)

( * ) Notice: Subject to any disclaimer, the term of this patent is extended or adjusted under 35 U.S.C. 154(b) by 0 days.

(21) Appl. No.: 12/806,718

(22) Filed: Aug. 19, 2010

(51) Int. Cl.
*D06C 3/06* (2006.01)
*D06C 7/00* (2006.01)

(52) U.S. Cl. ..... 26/106; 26/71; 26/99

(58) Field of Classification Search ..... 26/71, 99, 26/105, 106, 72, 87, 51, 101, 103, 104; 28/240, 28/245, 246, 165; 264/288.4, 288.8, 289.6; 34/60, 623, 620; 156/494, 495, 381, 582; 425/66; 492/28, 30, 31, 33–35, 37
See application file for complete search history.

(56) References Cited

U.S. PATENT DOCUMENTS 504,927 A * 9/1893 Mather ..... 26/105
634,307 A * 10/1899 Neidhardt ..... 26/106
1,563,704 A * 12/1925 Greis ..... 26/105
1,716,555 A * 6/1929 Kane ..... 26/99
3,234,662 A * 2/1966 Alexeff et al. ..... 34/556
3,545,054 A * 12/1970 Ishidoshiro et al. ..... 26/51
3,624,874 A * 12/1971 Lauchenauer ..... 26/105
3,672,013 A * 6/1972 Vernon et al. ..... 28/246
4,116,892 A * 9/1978 Schwarz ..... 521/62
4,566,162 A * 1/1986 Brands ..... 26/105
5,455,992 A * 10/1995 Kurschatke et al. ..... 26/99
5,943,747 A * 8/1999 Muller ..... 26/92
6,145,174 A * 11/2000 Podlesny et al. ..... 26/99

* cited by examiner

*Primary Examiner* — Amy Vanatta
(74) *Attorney, Agent, or Firm* — William E. Pelton, Esq; Cooper & Dunham LLP

(57) ABSTRACT

A stretching assembly for cloth has a heating furnace, a pressing device and a shaping device. The heating furnace has two opposite sidewalls and a channel. The channel is formed through the opposite sidewalls of the heating furnace and has an inlet and an outlet. The pressing assembly is set to face the inlet of the heating furnace and has a first pressing wheel and a second pressing wheel. The first pressing wheel has multiple annular protruding segments formed on an external surface of the first pressing wheel. The second pressing wheel parallel the first pressing wheel to form a curved clearance between the pressing wheels and has multiple annular concave segments formed on an external surface of the second pressing wheel. The shaping device is set to face the outlet of the heating furnace, aligns with the pressing device and has two shaping wheels.

15 Claims, 5 Drawing Sheets

STRETCHING ASSEMBLY FOR CLOTH

BACKGROUND OF THE INVENTION

1. Field of the Invention

The present invention relates to a stretching assembly, and more particularly to a stretching assembly for cloth to change the width of cloth and provide a high quality of cloth after stretching.

2. Description of Related Art

A conventional stretching assembly can stretch cloth to change the width of cloth to a desired level. With reference to FIG. 7, a conventional stretching assembly 70 for cloth has a heating furnace 60, a first transporting assembly 61, a second transporting assembly 62 and a rolling wheel 80. The heating furnace 60 has an inlet and an outlet. The first transporting assembly 61 is set on a side of the heating furnace 60 in which the inlet is formed to transport cloth 70 into the heating furnace 60 via the inlet. The fibers of cloth 70 are heated in the heating furnace 60 and may become soft, adhesive and deformable. The second transporting assembly 62 is set on a side of the heating furnace 60 in which the outlet is formed to transport cloth 70 out of the heating furnace 60 via the outlet. In use, the rotating speed of the second transporting assembly 62 is higher than that of the first transporting assembly 61. Thus, cloth 70 can be stretched due to the speed difference between the transporting assemblies 61, 62 to change and reduce the width of cloth to a desired level. After the stretching process, the cloth 70 with a desired width is reeled on the rolling wheel 80.

However, the deformation on the sides of the cloth 70 is larger than that on the middle of the cloth 70, so this will cause the density of cloth non-uniform and will influence the quality of the stretched cloth 70.

Therefore, the present invention provides a stretching assembly for cloth to mitigate or obviate the aforementioned problems.

SUMMARY OF THE INVENTION

The main objective of the present invention is to provide a stretching assembly for cloth that can change the width of cloth and provide a high quality of cloth after stretching.

The stretching assembly for cloth in accordance with the present invention has a heating furnace, a pressing device and a shaping device. The heating furnace has two opposite sidewalls and a channel. The channel is formed through the opposite sidewalls of the heating furnace and has an inlet and an outlet. The pressing assembly is set to face the inlet of the heating furnace and has a first pressing wheel and a second pressing wheel. The first pressing wheel has multiple annular protruding segments formed on an external surface of the first pressing wheel. The second pressing wheel parallel the first pressing wheel to form a curved clearance between the pressing wheels and has multiple annular concave segments formed on an external surface of the second pressing wheel. The shaping device is set to face the outlet of the heating furnace, aligns with the pressing device and has two shaping wheels.

Other objectives, advantages and novel features of the invention will become more apparent from the following detailed description when taken in conjunction with the accompanying drawings.

DETAILED DESCRIPTION OF THE PREFERRED EMBODIMENT

Figures 1A, 1B:
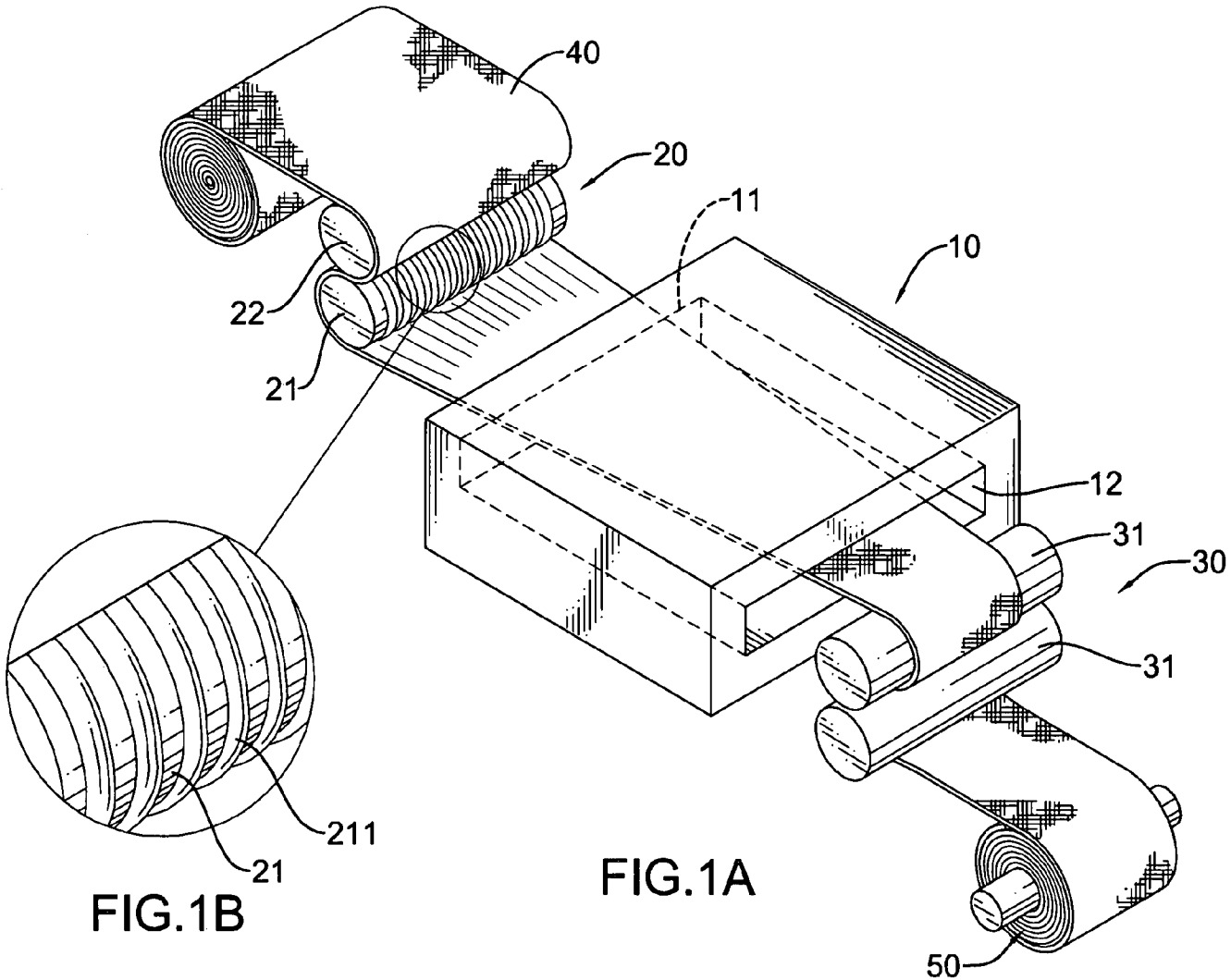
FIG. 1A is a perspective view of a stretching assembly in accordance with the present invention.
FIG. 1B is an enlarged perspective view of a first pressing wheel of the stretching assembly in FIG. 1A.

With reference to FIGS. 1A and 1B, a stretching assembly for cloth 40 in accordance with the present invention has a heating furnace 10, a pressing device 20 and a shaping device 30.

The heating furnace 10 has an interior, two opposite sidewalls, a heater and a channel. The heater is mounted in the interior of the heating furnace 10. The channel is formed through the opposite sidewalls of the heating furnace 10, communicates with the interior of the heating furnace 10 and has an inlet 11 and an outlet 12. The inlet 11 is formed in one of the sidewalls of the heating furnace 10. The outlet 12 is formed in the other sidewall of the heating furnace 10 and aligns with the inlet 11. The pressing assembly 20 is set to face the inlet 11 of the heating furnace 10 and has a first pressing wheel 21 and a second pressing wheel 22.

Figure 2:
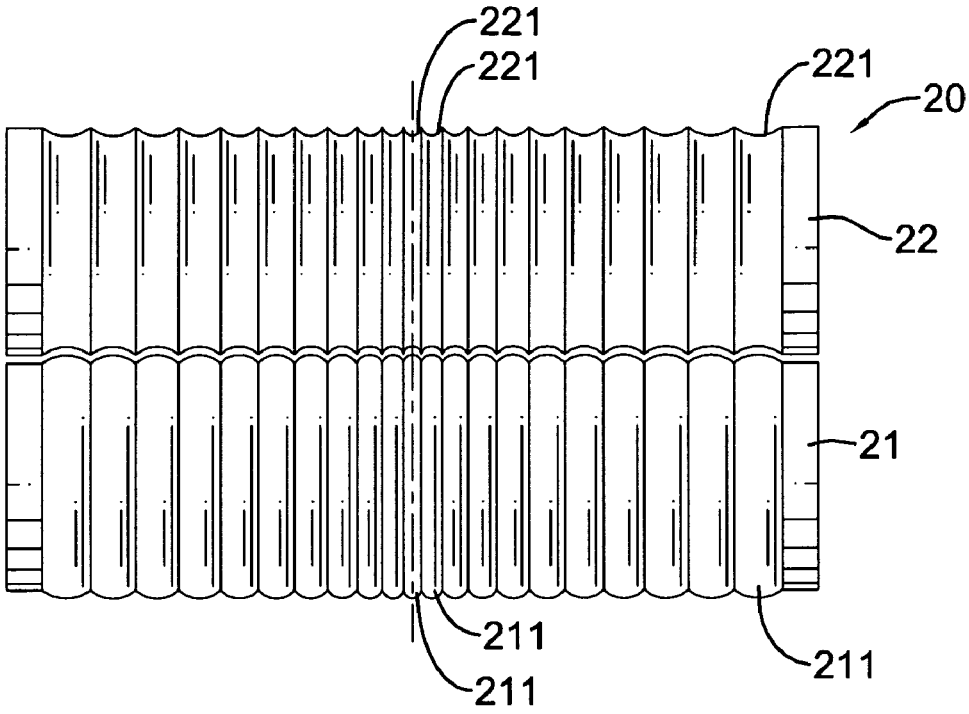
FIG. 2 is an enlarged side view of a first embodiment of a pressing device of the stretching assembly in FIG. 1.
Figure 3:
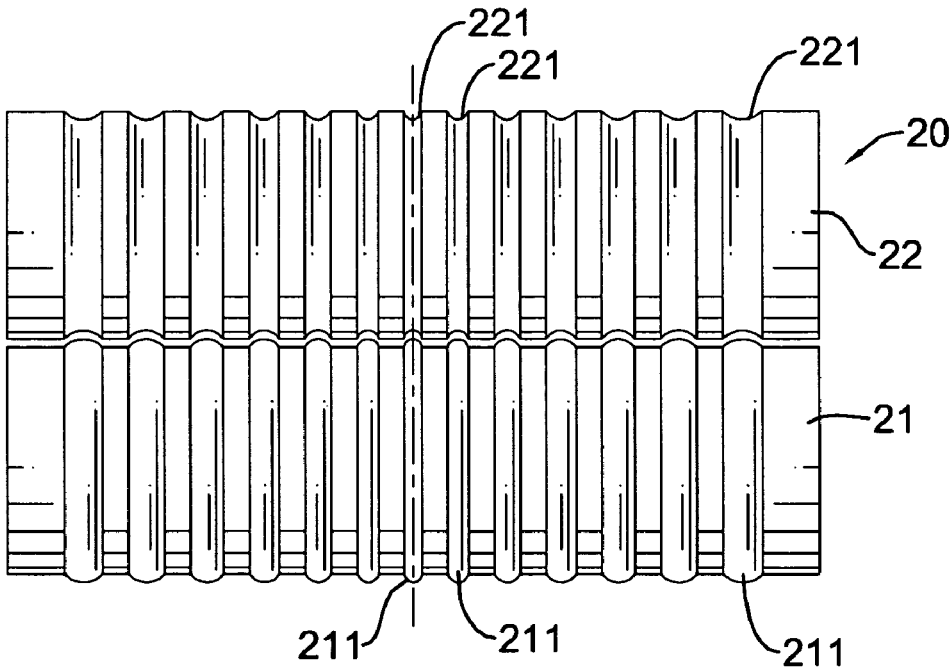
FIG. 3 is an enlarged side view of a second embodiment of a pressing device of the stretching assembly in FIG. 1.
Figure 4:
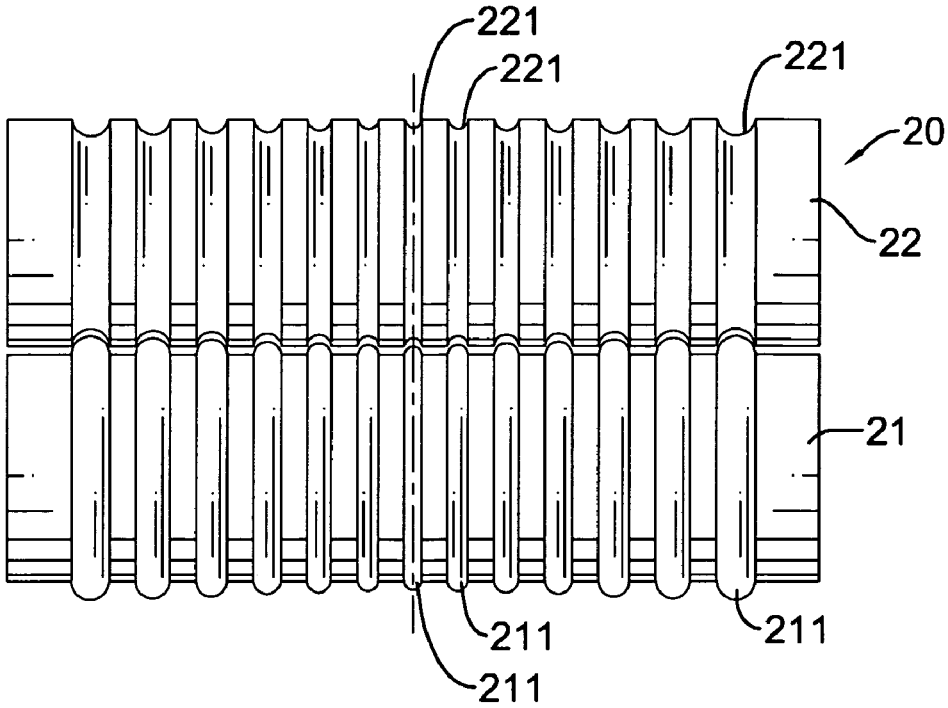
FIG. 4 is an enlarged side view of a third embodiment of a pressing device of the stretching assembly in FIG. 1.
Figure 5:
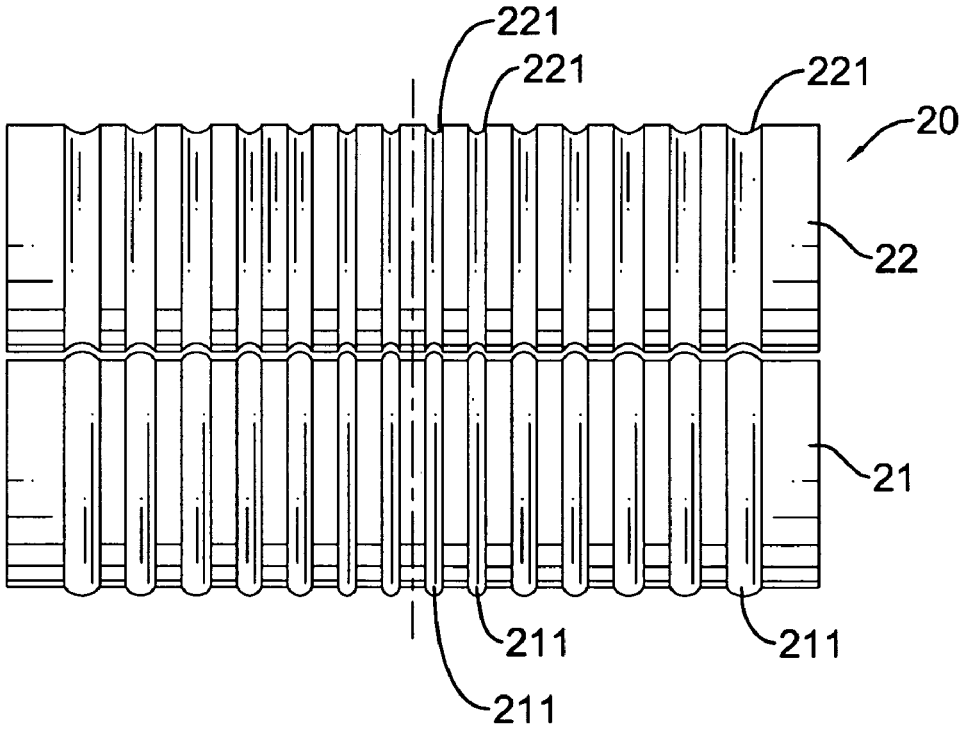
FIG. 5 is an enlarged side view of a fourth embodiment of a pressing device of the stretching assembly in FIG. 1.

The first pressing wheel 21 faces the inlet 11 of the heating furnace 10 and has an external surface, a middle, two ends and multiple annular protruding segments 211. With reference to FIGS. 2 to 5, the annular protruding segments 211 are formed around the external surface of the first pressing wheel 21 and each annular protruding segment 211 has a width and a height. The widths of the annular protruding segments 211 are increased from the middle to the ends of the first pressing wheel 21. The heights of the annular protruding segments 211 may be the same or be increased from the middle to the ends of the first pressing wheel 21. With reference to FIG. 2, the annular protruding segments 211 are continuously formed around the external surface of the first pressing wheel 21. With further reference to FIGS. 3 to 5, the annular protruding segments 211 are formed around the external surface of the first pressing wheel 21 at intervals. The external surface of the first pressing wheel 21 is smooth at the intervals. Preferably, with reference to FIGS. 3 and 4, one of the annular protruding segments 211 is defined at the middle of the first pressing wheel 21. In addition, the heights of the annular protruding segments 211 may be the same as shown in FIGS. 2, 3 and 5 and may be increased from the middle to the ends of the first pressing wheel 21 as shown in FIG. 4. Alternatively, with reference to FIG. 5, one of the intervals is defined at the middle of the first pressing wheel 21.

The second pressing wheel 22 is set over or below the first pressing wheel 21, is parallel with the first pressing wheel 21 to form a curved clearance between the pressing wheels 21, 22 and has an external surface, a middle, two ends and multiple annular concave segments 221 corresponding respectively to the annular protruding segments 211 on the first pressing wheel 21. With further reference to FIGS. 2 to 5, the annular concave segments 221 are formed around the external surface of the second pressing wheel 22 and each annular concave segment 221 has a width and a depth. The widths of the annular concave segments 221 are increased from the middle to the ends of the second pressing wheel 22. The depths of the annular concave segments 221 may be the same as shown in FIGS. 2, 3 and 5 and may be increased from the middle to the ends of the second pressing wheel 22 as shown in FIG. 4.

Figure 6:
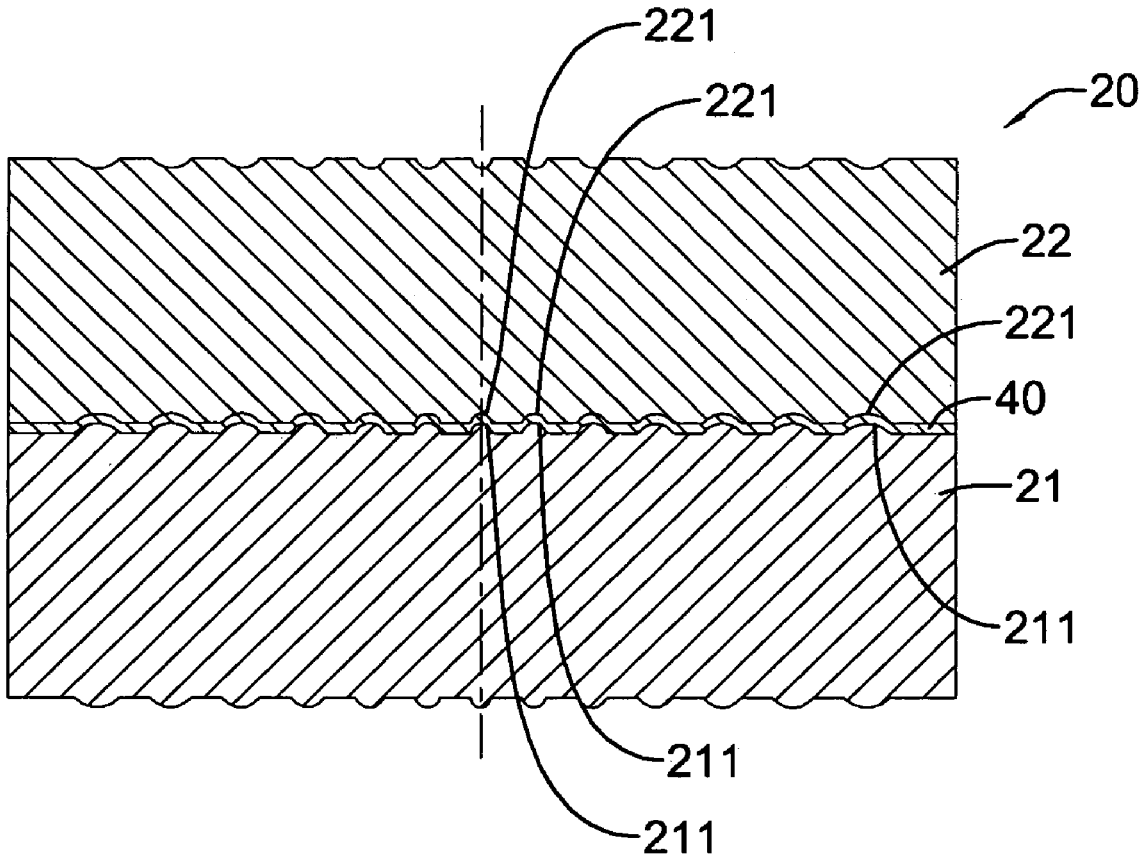
FIG. 6 is an enlarged operational cross sectional side view of the stretching assembly in FIG. 1.
Figure 7:
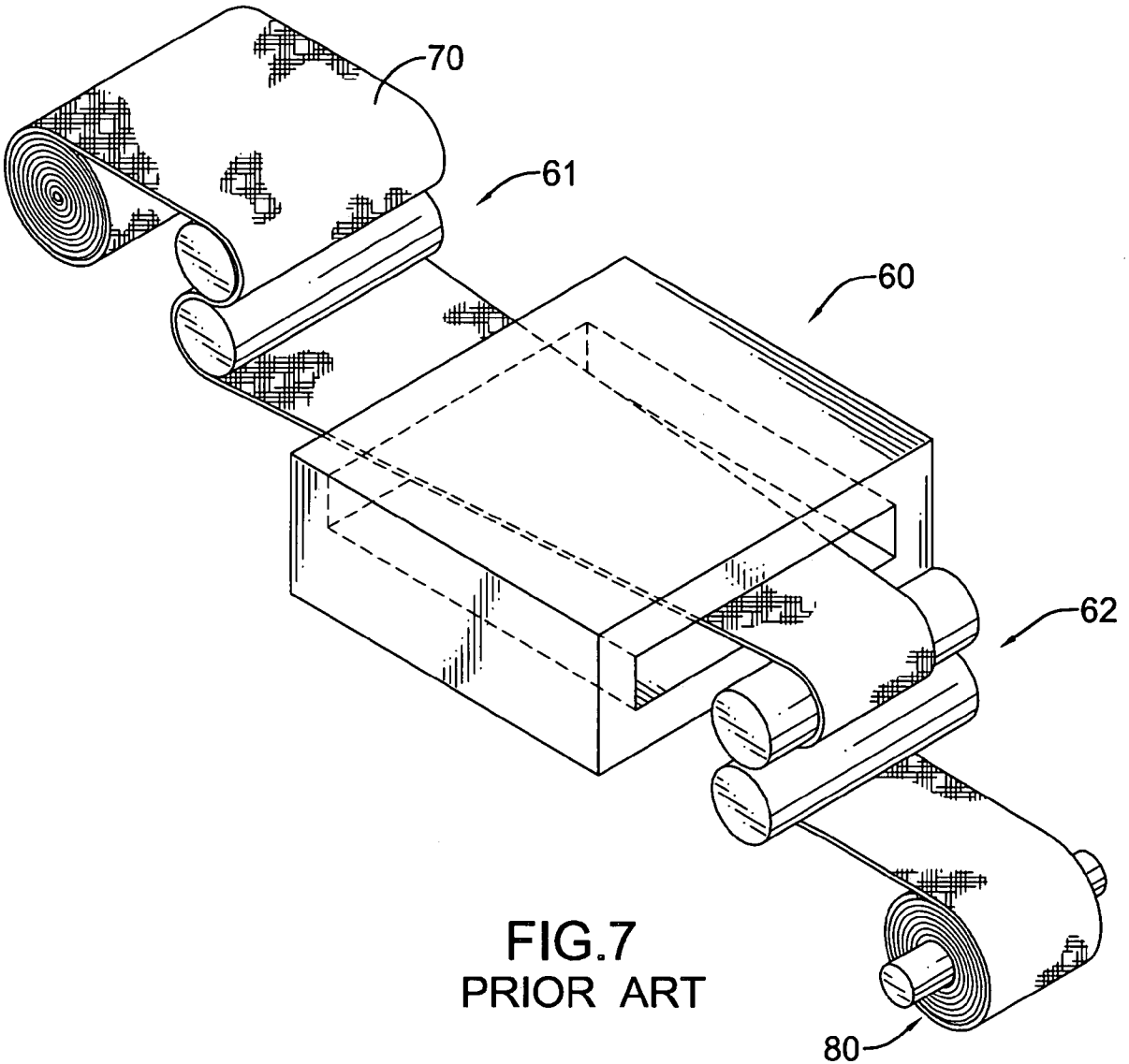
FIG.7 PRIOR ART
FIG. 7 is a perspective view of a stretching assembly in accordance with the prior art.

The shaping device 30 is set to face the outlet 12 of the heating furnace 10, aligns with the pressing device 20 and has two shaping wheels 31 and a rolling wheel 50. The shaping wheels 31 face the outlet 12 of the heating furnace 10, are parallel with each other and can be rotated in opposite direction, and each shaping wheel 31 has a smooth external surface. The rolling wheel 50 is set to face the shaping wheels 31 at a position opposite to the outlet 12 of the heating furnace 10. In operation, with reference to FIGS. 1A and 6, the pressing wheels 21, 22 of the pressing device 20 can be driven in the opposite directions to pull the cloth 40 into the pressing device 20 between the assorted annular protruding segments 211 and the annular concave segments 221, the compressing deformation of the cloth 40 are increased from the sides to the middle of the cloth 40 due to the structural characters of the widths of the annular protruding segments 211 and the annular concave segments 221 being increased from the middle to the ends of the pressing wheels 21,22.

After the pressing process of the pressing device 20, the cloth 40 is moved into the heating furnace 10, the heating temperature of the heating furnace 10 is set between the heat distortion point and the melting point of the cloth 40. Thus, the fibers of cloth 40 can be heated to become soft, adhesive and deformable. After the heating process of the heating furnace 10, the shaping wheels 31 of the shaping device 30 are driven in opposite directions to pull the cloth 40 into the shaping device 30 with a rotating speed higher than that of the pressing wheels 21, 22. Accordingly, the cloth 40 can be stretched due to the different rotating speeds of the pressing device 20 and the shaping device 30. During the stretching process, the drawing deformation on two sides of the cloth 40 is larger then that on the middle of the cloth 40. Therefore, after the pressing and shaping processes of the pressing device 20 and the shaping device 30, the density of the stretched cloth 40 will be uniform to provide a high quality of cloth 40 due to the balance of the compressing and drawing deformations of the cloth 40 on the sides and the middle.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A stretching assembly for cloth comprising
- a heating furnace having
  - two opposite sidewalls; and
  - a channel formed through the opposite sidewalls of the heating furnace and having
    - an inlet formed on one of the sidewalls of the heating furnace; and
    - an outlet formed on the other sidewall of the heating furnace and aligning with the inlet;
- a pressing device set to face the inlet of the heating furnace and having
  - a first pressing wheel facing the inlet of the heating furnace and having
    - an external surface;
    - a middle;
    - two ends; and
    - multiple annular protruding segments formed around the external surface of the first pressing wheel and each annular protruding segment having
      - a width and the widths of the annular protruding segments increased from the middle to the ends of the first pressing wheel; and
      - a height; and
  - a second pressing wheel set parallel the first pressing wheel to form a curved clearance between the pressing wheels and having
    - an external surface;
    - a middle;
    - two ends; and
    - multiple annular concave segments formed around the external surface of the second pressing wheel corresponding respectively to the annular protruding segments of the first pressing wheel and each annular concave segment having
      - a width and the widths of the annular concave segments increased from the middle to the ends of the second pressing wheel; and
      - a depth; and
- a shaping device set to face the outlet of the heating furnace, aligning with the pressing device and having
  - two shaping wheels facing the outlet of the heating furnace, being parallel with each other and each shaping wheel having a flat external surface.

2. The stretching assembly as claimed in claim 1, wherein
- the annular protruding segments are continuously formed around the external surface of the first pressing wheel; and
- the annular concave segments are continuously formed around the external surface of the second pressing wheel.

3. The stretching assembly as claimed in claim 1, wherein
- the annular protruding segments are formed around the external surface of the first pressing wheel at intervals;
- the external surface of the first pressing wheel is flat at the intervals;
- the annular concave segments are formed around the external surface of the second pressing wheel at intervals; and
- the external surface of the second pressing wheel is flat at the intervals.

4. The stretching assembly as claimed in claim 2, wherein
- the heights of the annular protruding segments are the same; and
- the depths of the annular concave segments are the same.

5. The stretching assembly as claimed in claim 3, wherein the heights of the annular protruding segments are the same; and
- the depths of the annular concave segments are the same.

6. The stretching assembly as claimed in claim 2, wherein
- the heights of the annular protruding segments are increased from the middle to the ends of the first pressing wheel; and
- the depths of the annular concave segments are increased from the middle to the ends of the second pressing wheel.

7. The stretching assembly as claimed in claim 3, wherein
- the heights of the annular protruding segments are increased from the middle to the ends of the first pressing wheel; and the depths of the annular concave segments are increased from the middle to the ends of the second pressing wheel.

8. The stretching assembly as claimed in claim 3, wherein one of the annular protruding segments is defined at the middle of the first pressing wheel; and one of the annular concave segments is defined at the middle of the second pressing wheel corresponding to the annular protruding segment at the middle of the first pressing wheel.

9. The stretching assembly as claimed in claim 5, wherein one of the annular protruding segments is defined at the middle of the first pressing wheel; and one of the annular concave segments is defined at the middle of the second pressing wheel corresponding to the annular protruding segment at the middle of the first pressing wheel.

10. The stretching assembly as claimed in claim 7, wherein one of the annular protruding segments is defined at the middle of the first pressing wheel; and one of the annular concave segments is defined at the middle of the second pressing wheel corresponding to the annular protruding segment at the middle of the first pressing wheel.

11. The stretching assembly as claimed in claim 3, wherein one of the intervals between the annular protruding segments of the first pressing wheel is defined at the middle of the first pressing wheel; and one of the intervals between the annular concave segments of the second pressing wheel is defined at the middle of the second pressing wheel corresponding to the interval at the middle of the first pressing wheel.

12. The stretching assembly as claimed in claim 5, wherein one of the intervals between the annular protruding segments of the first pressing wheel is defined at the middle of the first pressing wheel; and one of the intervals between the annular concave segments of the second pressing wheel is defined at the middle of the second pressing wheel corresponding to the interval at the middle of the first pressing wheel.

13. The stretching assembly as claimed in claim 7, wherein one of the intervals between the annular protruding segments of the first pressing wheel is defined at the middle of the first pressing wheel; and one of the intervals between the annular concave segments of the second pressing wheel is defined at the middle of the second pressing wheel corresponding to the interval at the middle of the first pressing wheel.

14. The stretching assembly as claimed in claim 10, wherein the shaping device further has a rolling wheel set to face the shaping wheels opposite the outlet of the heating furnace.

15. The stretching assembly as claimed in claim 13, wherein the shaping device further has a rolling wheel set to face the shaping wheels opposite the outlet of the heating furnace.

* * * * *